US005600937A

United States Patent [19]

Erickson et al.

[11] Patent Number: 5,600,937

[45] Date of Patent: Feb. 11, 1997

[54] DISPLAY CARD AND METHOD

[76] Inventors: Peter G. Erickson, 9125 Copper Ave., NE., #427, Albuquerque, N.M. 87123; Richard J. Shube, 3716 General Chenault, NE., Albuquerque, N.M. 87111

[21] Appl. No.: 398,437

[22] Filed: Mar. 3, 1995

[51] Int. Cl.[6] ..... B65B 15/02

[52] U.S. Cl. ..... 53/397; 53/414; 206/488; 206/566

[58] Field of Search ..... 53/399, 397, 409, 53/414, 139.4, 128.1, 204, 581, 582, 580, 592, 390; 206/488, 487, 493, 6.1, 566

[56] References Cited

U.S. PATENT DOCUMENTS

| | | | |
|---|---|---|---|
| 407,668 | 7/1889 | Kron | 206/488 |
| 712,806 | 11/1902 | Kaffeman | 206/506 X |
| 777,823 | 12/1904 | Webster et al. | 206/566 |
| 925,273 | 6/1909 | Beiser | 206/487 |
| 1,278,354 | 9/1918 | Kendis | 206/488 |
| 2,119,832 | 6/1938 | Schless | 206/566 |
| 2,472,532 | 6/1949 | Hellman | 206/488 |
| 2,962,156 | 11/1960 | Adams | 206/566 X |
| 3,660,873 | 5/1972 | Kawashima | 206/566 X |
| 3,937,319 | 2/1976 | Roy | 206/566 X |
| 4,697,705 | 10/1987 | Garganese | 206/488 |
| 4,880,117 | 11/1989 | Garganese | 206/487 |

FOREIGN PATENT DOCUMENTS

| | | | |
|---|---|---|---|
| 1551569 | 8/1979 | United Kingdom | G09F 1/02 |

*Primary Examiner*—James F. Coan

*Attorney, Agent, or Firm*—Deborah A. Peacock; Donovan F. Duggan; Jeffrey D. Myers

[57] ABSTRACT

An apparatus and method for displaying items in two orthogonal planes on a display card. The items are preferably extensibly secured to the display card by an elastic strand secured to opposed lateral portions of the item.

19 Claims, 1 Drawing Sheet

DISPLAY CARD AND METHOD

BACKGROUND OF THE INVENTION

1. Technical Field

The invention relates to a display card; more particularly to a display card for mounting items to be displayed and retained in orthogonal planes on the card, and a method for mounting display items on such display card.

2. Background Art

The jewelry art is replete with display devices and holders for various items of jewelry. Kron, U.S. Pat. No. 407,668, entitled "Holder for Finger Rings," discloses a ring display card having a rotatable portion for locking the ring in position. Webster et al., U.S. Pat. No. 777,823, entitled "Display Card for Jewelry," discloses a mounting board for rings having a spring-loaded clasp for retaining the rings to the board. Kendis, U.S. Pat. No. 1,278,354, entitled "Jewelry Display Tray and Holder," discloses a ring retainer wherein the rings are retained by spring-loaded jaws. Similarly, U.S. Pat. No. 2,119,832, to Schless, entitled "Display Frame or the Like," uses concave-convex jaws for gripping the rings on display.

U.S. Pat. No. 2,472,532, to Hellman entitled "Button Card," discloses a button displaying device employing a ring-shaped mount insertable in a display card. U.S. Pat. No. 4,697,705, to Garganese, entitled "Jewelry Display Device," discloses frictional resilient material for gripping a jewelry item on display. Garganese, U.S. Pat. No. 4,880,117, entitled "Display Card Assembly for Ring-like Ornamental Articles," discloses an apertured display card assembly which retains a jewelry article by means of an elongated retaining member across the bottom of the aperture. Although the jewelry item is mounted upright in the aperture, no provision is made for flat mounting of the jewelry item. British Patent Specification 1,551,569, to Kohn, entitled "Display Cards," discloses a jewelry display card having a slit therein with rounded ends for holding and displaying ring-like jewelry members in an upright position.

U.S. Pat. No. 925,273, to Beiser, entitled "Toy," discloses a toy figurine mountable in either an upright or flat position by means of inflexible, rigid pintles bearingly mounted in openings in a base. Manifestly, Beiser's device is not extensibly hinged, although relevant.

None of the prior art, however, discloses a display card for jewelry items wherein the item may be mounted, retained and supported in either a horizontal or vertical position, relative to a display card, by means of elastic or extensible retention means.

SUMMARY OF THE INVENTION (DISCLOSURE OF THE INVENTION)

The present invention is of a method and apparatus for displaying an item in two substantially orthogonal planes comprising: providing a display card; mounting an item to be displayed on the display card by extensibly securing the item to the display card; displaying the item in a plane substantially parallel to the display card; and displaying the item in a plane substantially perpendicular to the display card. In the preferred embodiment, the display card may be slotted, laminated, or apertured. Mounting is accomplished by extensibly securing opposed lateral portions of the item to the display card by a single elastic member, a plurality of elastic members, a single inelastic member, or a plurality of inelastic members. When an elastic member is employed, mounting may be done by looping the elastic member through one aperture of the display card and about one lateral portion of the item, extending the elastic member across the width of the item, and looping the elastic member through another aperture of the display card and about another lateral portion of the item.

A primary object of the invention is to provide a display card for displaying items in one of two orthogonal positions;

It is another object of the invention to provide a jewelry display card which can easily be stored, shipped or displayed in stacked configuration;

Still another object of the invention is the provision of a jewelry display card wherein the display item is extensibly yet firmly attached to the display card;

Yet another object of the invention is the provision of a method for attaching a jewelry item to a display card;

An advantage of the display card of the present invention is its ease of manufacture and application;

Another advantage of the display card of the present invention is its function as a storage and shipping apparatus as well as a display apparatus;

Still another advantage of the present invention is its inexpensiveness; and

Yet another advantage of the invention is its adaptability to conversion of existing display card stock.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

While display cards have long been used to display jewelry including rings, earrings, pins, broaches and similar items, there has long been felt a need to display such items in more than one configuration. For example, on occasion it may be more desirable to display a ring in a recumbent or horizontal configuration, as opposed to the normal upright or vertical finger ring display configuration. (As used herein, "horizontal" denotes a configuration wherein the display item is mounted in a plane substantially parallel to the display card while "vertical" denotes a configuration wherein the display item is mounted in a plane substantially perpendicular to the display card.) It would be extremely advantageous for a display card to comprise both a vertical and horizontal mounting capability.

Further, the capability of selectively mounting a display element either horizontally or vertically upon a display card would ameliorate shipping and storage requirements. Display items can more easily be shipped and stored in a flat, horizontal, stacked configuration than in an upright configuration. The present invention permits selection of either mounting capability. This dual capability also permits a display item in an upright configuration to be on the top of a stack of display items in horizontal configuration, and thus combination of storage efficiency and display of all facets of a displayed article.

Figure 1:
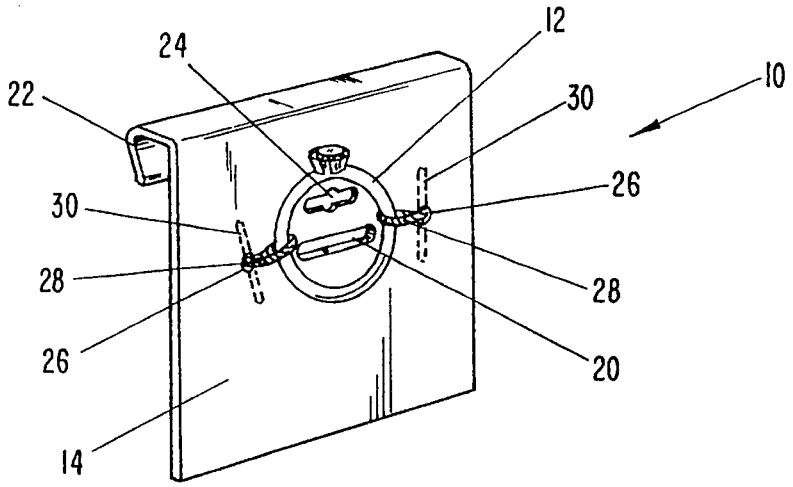
FIG. 1 is a top perspective view of the display card of the invention with the display item horizontal.
Figure 2:
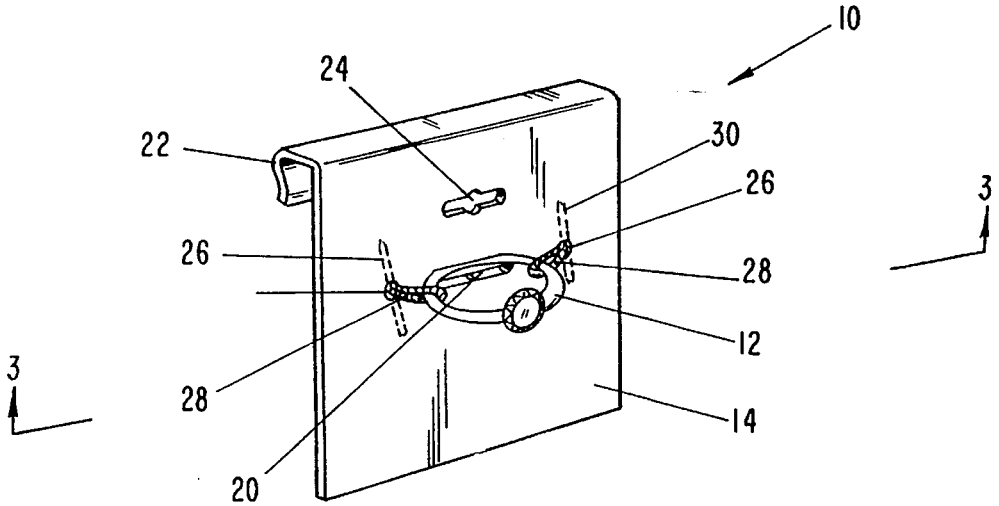
FIG. 2 is a top perspective view of the display card of the invention with the display item vertical.
Figure 3:
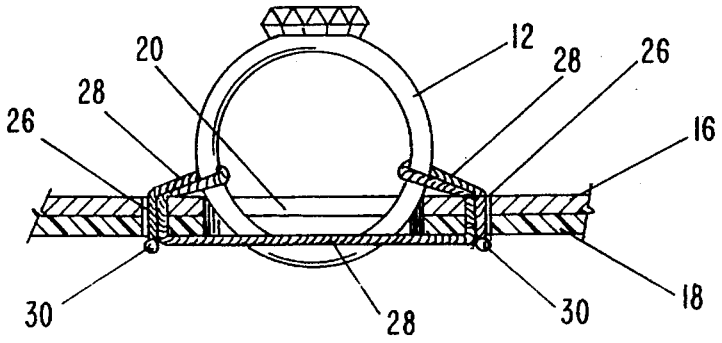
FIG. 3 is a sectional view taken along line 3—3 in FIG. 2.

With reference to FIGS. 1–3, the preferred embodiment of the invention 10 is therein depicted. FIG. 1 shows display item 12, in this case a finger ring, mounted upon display card 14. Display card 14 is a laminated structure preferably comprising a topmost layer 16 of opaque paper, cardboard, pasteboard material, and the like, while bottom layer 18 preferably comprises transparent plastic material and the like. Layers 16 and 18 are secured together by any known means or process in the art including cementing, gluing, heating and the like.

Display card 14 further comprises mounting slot 20. The length of mounting slot 20 is slightly less than the width dimension of the item to be displayed; in this case, less than the outer diameters of the finger ring 12 annulus. The width of slot 20 is such that it accommodates the thickness of the item to be displayed; in this case, the thickness of the finger ring annulus.

Display card 14 further comprises hanger portion 22. Hanger portion 22 enables card 14 to be suspended; holder or aperture such as keyhole stacking slot 24 (preferably a standard keyhole aperture) enables display card 14 to be hung on a post. Apertures 26 enable securement of ring 12 to card 14 in a manner to be disclosed.

In the preferred embodiment, finger ring 12 is secured at diametrically opposite or opposed portions thereof by blunt tipped elastic barb 28. Barb, or "bobby", 28 elastically, resiliently and extensibly secures ring 12 to display card 14. (As used herein, "extensibly" and "extensible" refer to a hinged securement wherein the item can be moved towards and away from the display card in a plurality of directions, yet remains firmly attached thereto.)

In the preferred embodiment, "bobby" 28 is looped about one lateral ring portion of ring 12 through one aperture 26, then extended laterally under card 14 to the other aperture 26, and looped about the other lateral portion of ring 12. Blunt tips 30 prevent "bobby" 28 from slipping back through apertures 26.

Use of the display card of the invention is virtually self-explanatory. To mount the display item in a horizontal or recumbent position, the item is merely removed from slot 20 and "snapped" downwardly to lie in a plane parallel to the display card 14, still secured thereto by elastic "bobby" 28. To mount the item in a upright or vertical position, the item is extended outwardly, then inserted into slot 20. Ring 12 is still retained in the upright or vertical position by elastic "bobby" 28.

Many modifications and variations will occur to those ordinarily skilled in the art. As noted previously, display item 12 need not be a finger ring or even an item of jewelry, but may comprise any item lending itself to display in two relatively orthogonal planes. Further, retention "bobby" 28 may comprise any known elastic or inelastic strand material including but not limited to rubber bands, string, cordage thread and the like. If inelastic securing strands are used, sufficient slack must be present to allow extensibility of the item relative to the card for mounting in both planes. The retention material may comprise two loops of material about the opposed ring portion, as well as any other well known securement techniques. Whatever the securing means, it must allow extension of the item away from the display card for mounting, yet retain the item in both mounting positions.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A method of displaying an item lending itself to display in two substantially orthogonal planes comprising the steps of:

a) providing a display card;

b) mounting an item to be displayed directly on the display card by extensibly securing the item directly to the display card;

c) displaying the item in a plane substantially parallel to the display card; and d) displaying they item in a plane substantially perpendicular to the display card.

2. The method of claim 1 wherein the step of providing a display card comprises providing a slotted display card.

3. The method of claim 1 wherein the step of providing a display card comprises providing an aperture display card.

4. The method of claim 1 wherein the step of providing a display card comprises providing a laminated display card.

5. The method of claim 1 wherein the step of mounting an item to be displayed comprises extensibly securing opposed lateral portions of the item directly to the display card.

6. The method of claim 5 wherein the step of mounting an item to be displayed comprises extensibly securing opposed lateral portions of the item directly to the display card by a single elastic member.

7. The method of claim 5 wherein the step of mounting an item to be displayed comprises extensibly securing opposed lateral portions of the item by a plurality of elastic members.

8. The method of claim 5 wherein the step of mounting an item to be displayed comprises extensibly securing opposed lateral portions of the item by a single inelastic member.

9. The method of claim 5 wherein the step of mounting an item to be displayed comprises extensibly securing opposed lateral portions of the item by a plurality of inelastic members.

10. The method of claim 5 wherein the step of mounting an item to be displayed comprises the steps of looping an elastic member through one aperture of the display card and about one lateral portion of the item, extending the elastic member across the width of the item, and looping the elastic member through another aperture of the display card and about another lateral portion of the item.

11. An apparatus for displaying an item in two substantially orthogonal planes, said apparatus comprising:

means comprising a display card;

means for mounting the item directly on said display card by extensibly securing the item directly to said display card;

means for displaying the item in a plane substantially parallel to said display card; and means for displaying the item in a plane substantially perpendicular to said display card.

12. The apparatus of claim 11, wherein said means comprising a display card comprises means comprising a slotted display card.

13. The apparatus of claim 11 wherein said means comprising a display card comprises means comprising an apertured display card.

14. The apparatus of claim 11 wherein said means comprising a display card comprises means comprising a laminated display card.

15. The apparatus of claim 11 wherein said means for mounting the item directly on said display card comprises means for extensibly securing opposed lateral portions of the item directly to said display card by a single elastic member.

16. The apparatus of claim 11 wherein said means for mounting the item on said display card comprises means for extensibly securing opposed lateral potions of the item directly to said display card by a plurality of elastic members.

17. The apparatus of claim 11 wherein said means for mounting the item directly on said display card comprises means for extensibly securing opposed lateral potions of the item directly to said display card by an inelastic member.

18. The apparatus of claim 11 wherein said means for mounting the item directly on said display card comprises means for extensibly securing opposed lateral potions of the item directly to said display card by a plurality of inelastic members.

19. The apparatus of claim 15 wherein said means for mounting the item directly on said display card comprises means for looping said single elastic member through one aperture of said display card and about one lateral portion of the item, extending said elastic member across the width of the item, and looping said elastic member through another aperture of said display card, and about another lateral portion of the item.

* * * * *